US005358236A

United States Patent [19]

Maass et al.

[11] Patent Number: 5,358,236

[45] Date of Patent: Oct. 25, 1994

[54] TABLE COVER

[75] Inventors: Burkhard Maass; Jürgen Rautert, both of Heidelberg, Fed. Rep. of Germany

[73] Assignee: Heidelberger Druckmaschinen AG, Heidelberg, Fed. Rep. of Germany

[21] Appl. No.: 45,043

[22] Filed: Apr. 7, 1993

[30] Foreign Application Priority Data

Apr. 9, 1992 [DE] Fed. Rep. of Germany ..... 4211922

[51] Int. Cl.[5] ..... B65H 9/16; B65H 9/04

[52] U.S. Cl. ..... 271/248; 271/253; 271/255

[58] Field of Search ..... 271/248, 249, 236, 238, 271/253, 255, 251, 240; 226/199

[56] References Cited

U.S. PATENT DOCUMENTS 383,816 5/1888 Knudtson et al. ..... 271/255
3,227,443 1/1966 Pasquinelli ..... 271/248
4,844,441 7/1989 Motohashi ..... 271/253

FOREIGN PATENT DOCUMENTS 0268693 6/1989 European Pat. Off. .
468077 10/1928 Fed. Rep. of Germany ..... 271/248
4105966 5/1992 Fed. Rep. of Germany .
2253204 9/1992 United Kingdom .

*Primary Examiner*—H. Grant Skaggs
*Attorney, Agent, or Firm*—Herbert L. Lerner; Laurence A. Greenberg

[57] ABSTRACT

Table cover in the vicinity of a positionally adjustable side lay of a sheet-fed printing press includes a member defining a continuous surface of a table top extending over a distance corresponding to a range of width of a sheet format adjustable by a selective positioning of the side lay, the member defining the continuous surface being formed with flexible regions, and with regions yieldable to the side lay at all positions of the side lay.

9 Claims, 5 Drawing Sheets

TABLE COVER

The invention relates to a table cover in the vicinity of a side lay of a sheet-fed printing press.

To change from a broader, i.e., wider, to a narrower paper format of sheets which are to be printed in a sheet-fed printing press, it has become known heretofore to vary the lateral position of side lays to adjust to the new paper format which is to be printed. From the published European Patent Document 0 268 693 B1, it has become known heretofore, for the purpose of effecting infinitely variable format adjustment, to provide U or V-shaped sheet-guiding spring elements between the side lays and a table plate covering the center of the table. When the paper format is being reduced, the side lay, against the spring action of the juxtaposed spring elements, compresses the spring elements, and thereby reduces the angles defined by the legs of the spring elements. When the side lay is changed over to accommodate a larger paper format, the angles open or widen due to the restoring force of the spring elements; the juxtaposed spring elements forming the table cover can be compressed at most to the block length, which underlies or forms the basis for the row of spring elements, between the side lay and the plate covering the center of the table. A smallest possible paper-format setting is thus additionally limited in an undesired manner by the block length. Due to the lengthening of the spring elements in the sheet-conveying direction when the side lay is set to a smaller paper format and due to the shortening thereof when the side lay is set to a larger paper size, respectively, gaps are provided, moreover, between the spring elements and the table tops disposed upstream and downstream therefrom in the sheet-conveying direction, the gaps being thus also located upstream and downstream from the spring elements in the sheet-conveying direction, and being disposed transversely to the sheet-conveying direction, in order to effect the change in length of the spring elements, the size of the gaps varying in accordance with the adjusted format setting. Particularly for large format widths, the gaps represent so-called "stumbling blocks" for the conveyed paper sheets. Reliable guidance of the sheets cannot be assured with spring elements according to the aforementioned published European Patent Document 0 268 693 B1. Moreover, such a table cover permits relatively easy transmission of undesired particles therethrough. It is very easy for lubricants and rubbed-off particles from the transmission or gear-drive region below the table top to pass between the legs of the spring elements and onto the paper sheets; likewise, it is possible for paper dust and similar particles, which may possibly adhere to the paper sheets, to get into the transmission or gear-drive below the table top, for example, into the side-lay transmission or gear drive. Both phenomena have an adverse effect on the reliable guidance of the sheets.

Heretofore known from U.S. Pat. No. 3,227,443 is a table cover in the vicinity of side lays, including juxtaposed table-top elements which are articulatingly connected to one another, a first element of the table-top elements, which are in the form of a row, being connected to a side lay. The row of table-top elements are displaceably guided perpendicularly to the sheet-conveying direction. When the paper sheet format is reduced, the row of individual table-top elements is displaced towards the center of the table with the aid of the side lay. In the vicinity of the table plate covering the center of the table, the table-top elements are deflected by the guides, under this table plate, and they are thereat displaced farther towards the center of the table, in a direction parallel to this table plate. An adjustment from a very large paper-sheet format to a very small paper-sheet format is also possible thereat only to a very limited extent. In order to obtain the smallest possible paper-format setting with such a table cover, it is necessary for the table plate covering the center to be given a width of such dimension that the row of table-top elements can be displaced more or less completely under the table plate. In order to change to as a large a paper-sheet format as possible, however, it is sensible, with such a table cover, to make the row of table-top elements as long as possible. Making the row of elements as long as possible, on the one hand, coupled with the requirement for the row of elements to be covered, on the other hand, as exactly as possible by the table plate which covers the center, means that a setting to a very small sheet format is not possible with such a table cover, given a realistic desired maximum sheet format.

It is accordingly an object of the invention, therefore, to provide a relatively simple table cover for reliably guiding sheets in the vicinity of a side lay with optimized infinitely variable format adjustment.

With the foregoing and other objects in view, there is provided, in accordance with the invention, a table cover in the vicinity of a positionally adjustable side lay of a sheet-fed printing press, comprising means defining a continuous surface of a table top extending over a distance corresponding to a range of width of a sheet format adjustable by a selective positioning of the side lay, the means defining the continuous surface being formed with flexible regions, and with regions yieldable to the side lay at all positions of the side lay. With such a table cover, the space required by the side lay in order to assume or take up a position thereof is formed by providing that the continuous surface of the table top yields or gives way to the side lay. The table surface covering the center of the table can thus be dimensioned irrespective of the desired sheet-format width variation range. Because the surface means forming the table cover is continuous and yields or gives way to the side lay, and not the table surface which covers the center of the table, as is taught by U.S. Pat. No. 3,227,443, it is possible for the table surface which forms the center of the table, for example, a table plate or a suction belt, to be made very small. The continuous surface means may be constructed for a very large sheet-format width variation range. So-called stumbling blocks for the conveyed sheets are very markedly prevented with such a table cover.

In accordance with another feature of the invention, the means defining the continuous surface comprises an integral member having a uniformly flexible surface, and means for guiding the member around the side lay. This construction ensures the possibility of using relatively simple means for the continuous surface to yield or give way in a particularly safe and reliable manner, with the uniformly flexible surface also reducing the risk of stumbling blocks transverse to the sheet-conveying direction.

In accordance with a further feature of the invention, the integral member is a flexible belt extending in a direction corresponding to the direction in which the side lay is positionally adjustable for setting the format width of a sheet.

In accordance with a more specific feature of the invention, the flexible belt is formed of pliable metal.

In accordance with an alternative feature of the invention, the flexible belt is formed of tensionally rigid, yet pliable fabric.

The last three features of the invention permit the construction of particularly preferred, simple, advantageous embodiments of the uniformly flexible surface means.

In accordance with an added feature of the invention, the flexible belt is fastened at one end thereof to a fixed location at a central region of the table top, and at the other end thereof to a side frame of the printing press, and the guiding means are disposed on the side lay and serve for guiding the flexible belt.

In accordance with an alternative feature of the invention, one end of the flexible belt is fastened at a side of the table cover extending away from the side lay towards the center of the table top, and the other end thereof is fastened at a side of the side lay extending away from the center of the table top, and the guiding means are disposed on a frame of the printing press and at substantially the center of the table top, and serves for deflecting the flexible belt.

The last two alternative constructions of the invention offer the possibility of using relatively simple means for ensuring that the uniformly flexible surface will yield or give way in a particularly safe and reliable manner.

In accordance with yet another feature of the invention, the flexible belt comprises means for making a displacement measurement for setting and/or determining the position of the side lay. This makes it possible, in a particularly simple manner, to obtain precise positioning of the side lay to the desired position and, thus, improve the infinitely variable sheet-format width adjustment.

In accordance with yet a further feature of the invention, the flexible belt comprises actuating means for adjusting the side lay. This construction permits the possibility of effecting the adjustment of the side lay to an infinitely variable desired position using simple means without additional actuating means.

In accordance with a concomitant feature of the invention, the continuous surface is a closed surface. Thus, a particularly advantageous embodiment of the invention is provided wherein the possible transmission through the table cover of particles which impede reliable guidance of the sheets is, to a very great extent, prevented.

Other features which are considered as characteristic for the invention are set forth in the appended claims.

Although the invention is illustrated and described herein as embodied in a table cover, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
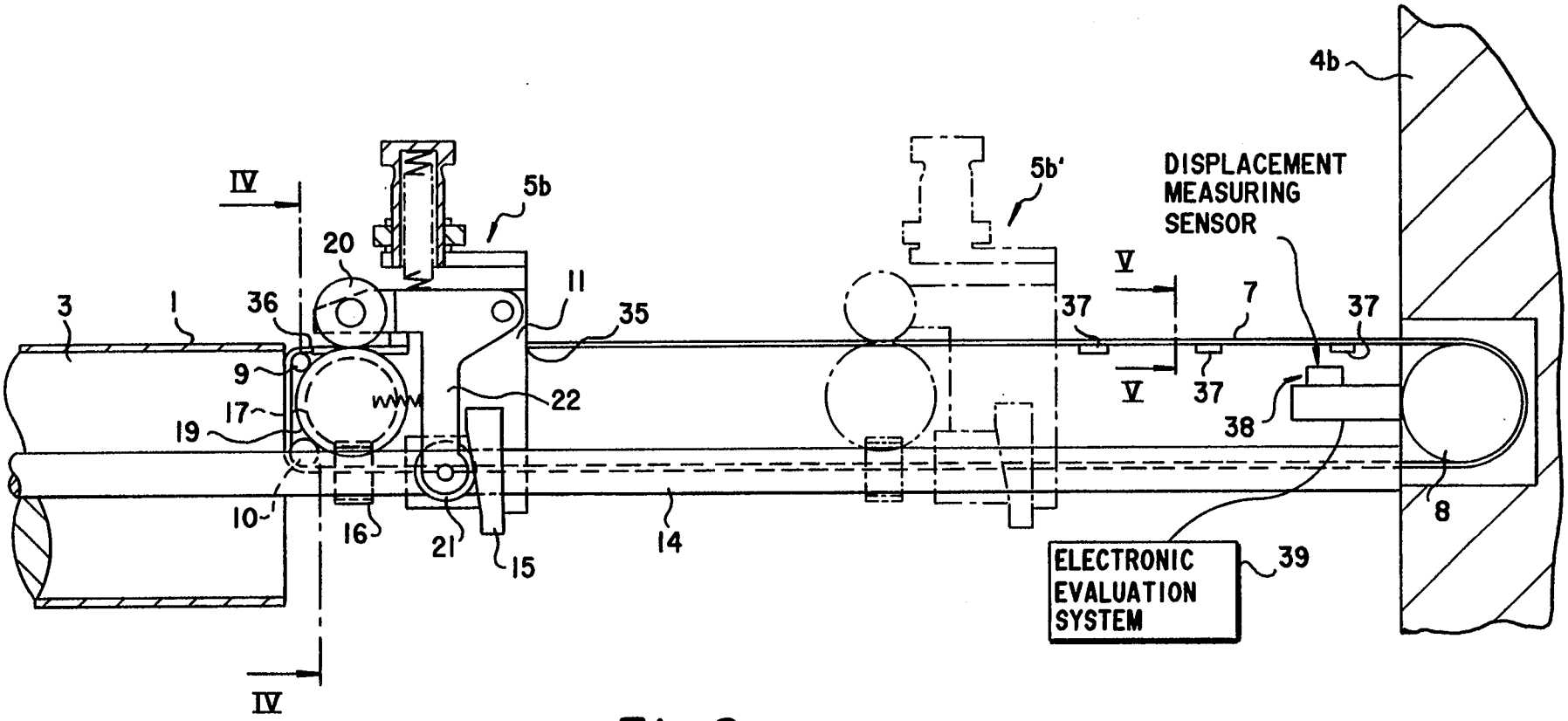
FIG. 2 is a fragmentary, enlarged sectional view of FIG. 1, taken along the line II—II in the direction of the arrows.
Figure 3:
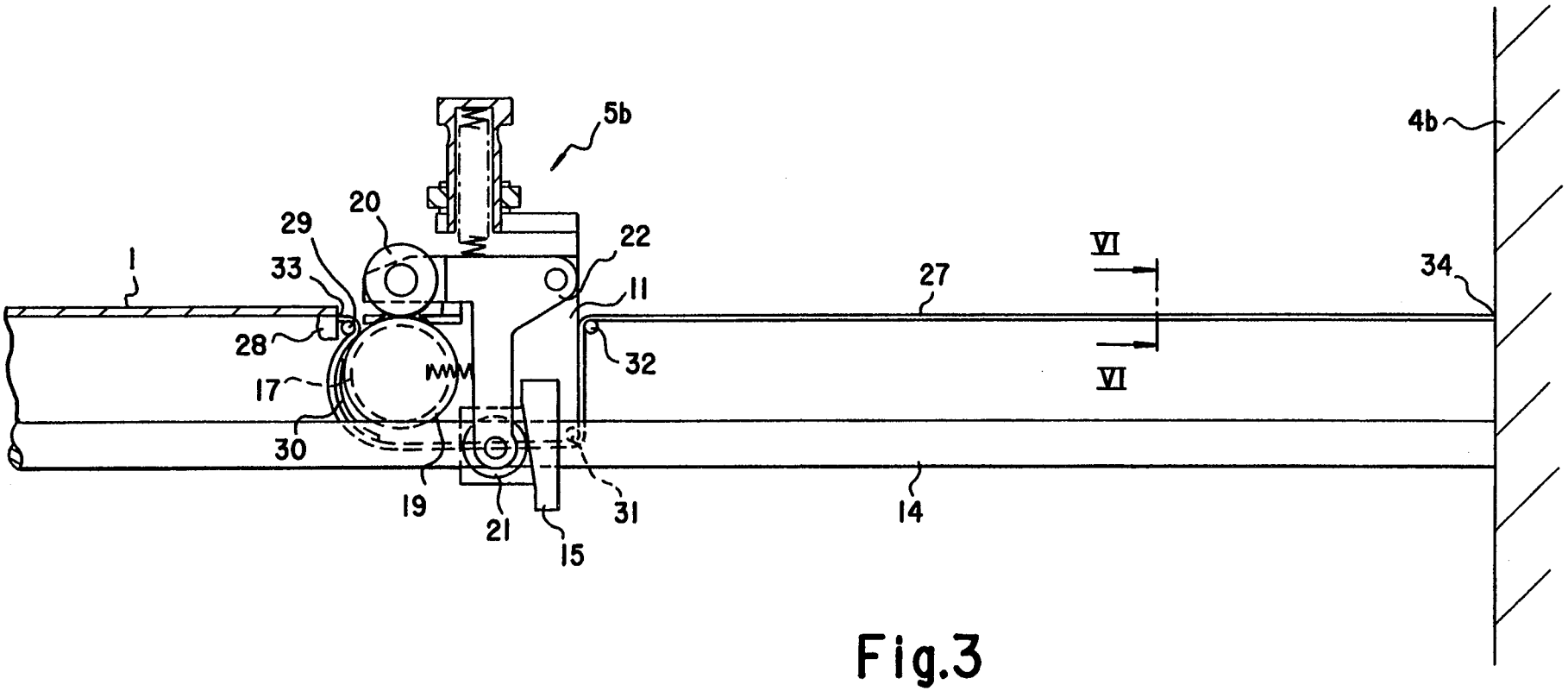
FIG. 3 is a view like that of FIG. 2 of a second embodiment of the invention wherein the belt is fixed to the table.
Figure 5A:
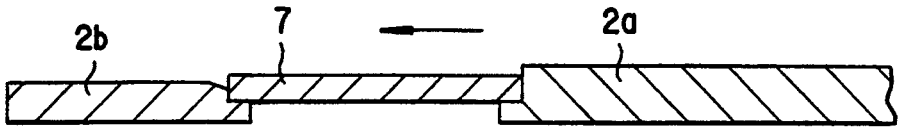
Figure 5B:
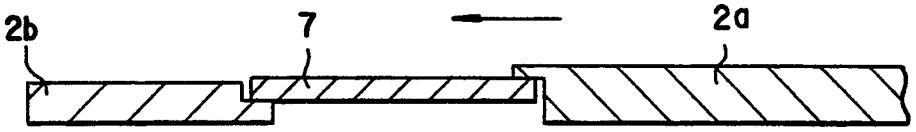
Figure 6:
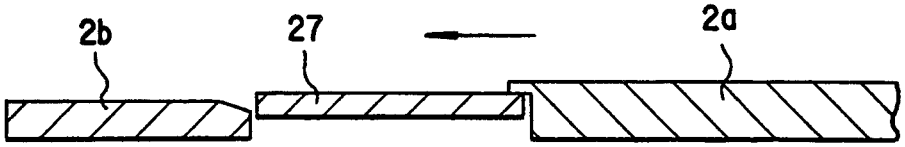

FIGS. 5*a* and 5*b* are enlarged cross-sectional views of FIG. 2 taken along the line V—V in the direction of the arrows and showing two different embodiments of means for guiding the revolving belt; and FIG. 6 is an enlarged cross-sectional view of FIG. 3 taken along the line VI—VI in the direction of the arrows and showing the guidance of the belt in the second embodiment of the invention.

Figure 1:
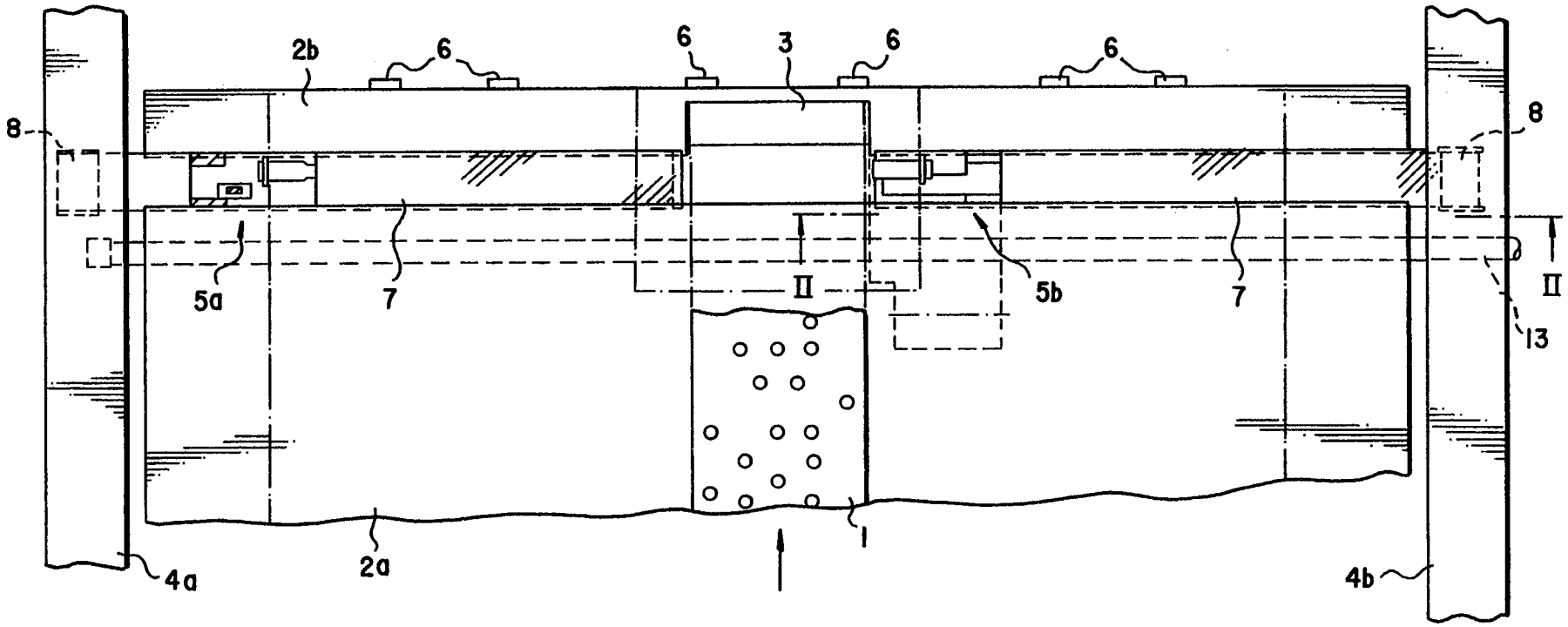
FIG. 1 is a fragmentary top plan view of a first embodiment of the table cover according to the invention, in the vicinity of diagrammatically represented side lays and with a revolving belt.

Referring now to the drawings and, first, particularly to FIGS. 1 and 2 thereof, there is shown therein a table top 2*a*, mounted in side parts or frames 4*a* and 4*b* of a sheet-fed printing press, and a revolving suction belt 1 of conventional construction disposed between side lays 5*a* and 5*b* and across a pliable and tensionally rigid metal belt 7, for transporting non-illustrated paper sheets from a non-illustrated sheet pile over the table top 2*a*. The paper sheets are laterally aligned in position at one of the side edges thereof by a side lay 5. In connection therewith, the revolving suction belt 1 brings the paper sheets across a table top 2*b* up against diagrammatically represented front lays 6, at which the sheets are aligned along the respective leading edges thereof. After having been aligned, the paper sheets are fed in a conventional manner to a non-illustrated printing unit of the press. The suction belt 1 is guided around guide rollers, of which, in the interest of clarity, merely the guide roller 3 located downstream from the side lays 5*a* and 5*b*, as viewed in the direction of sheet travel represented by the vertical arrow at the bottom of FIG. 1, is diagrammatically represented.

Figure 4:
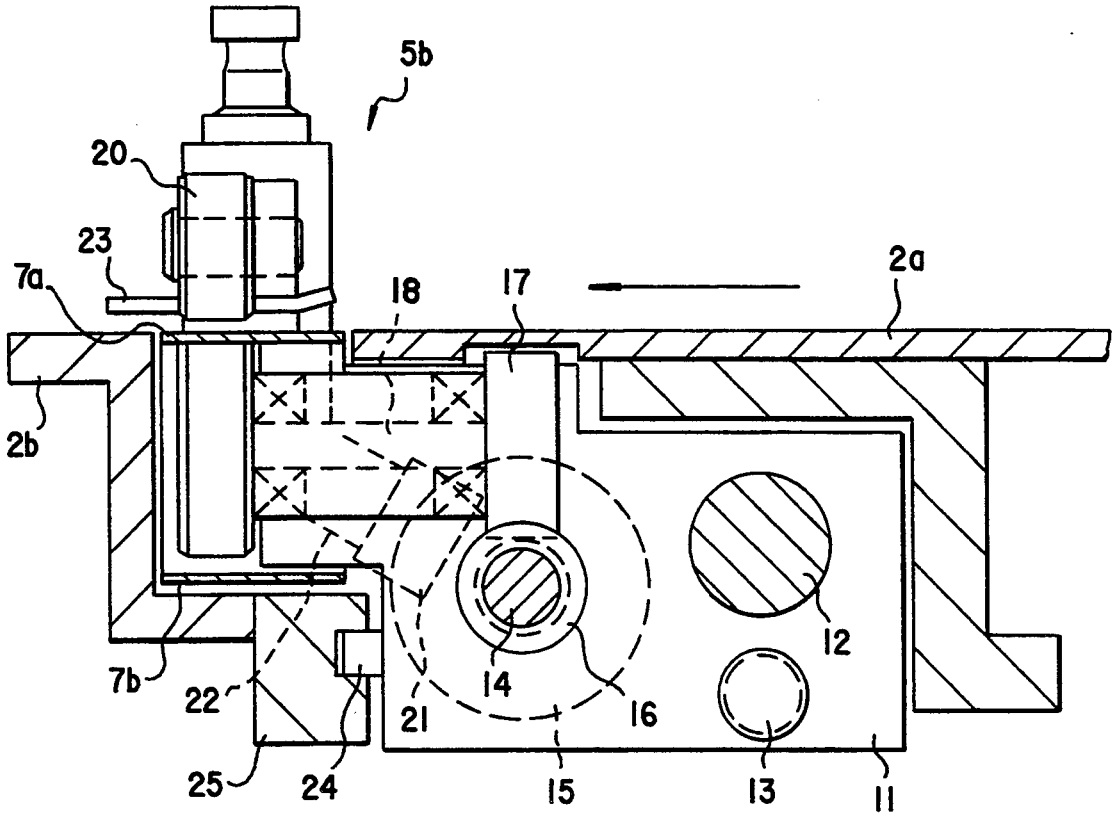
FIG. 4 is an enlarged cross-sectional view of FIG. 2, taken along the line IV—IV in the direction of the arrows.

As is shown by way of example in FIG. 4, the side lay 5*b* is formed of a side-lay body 11, which is axially displaceably and rotatably mounted on a guide shaft 12 fastened at opposite ends thereof in the printing-press side frames 4*a* and 4*b* and aligned transversely to the sheet-conveying direction. Furthermore, the side-lay body 11 is axially displaceably mounted by means of a sliding pad 24 in a sliding rail which is aligned transversely to the sheet-conveying direction and fastened to the table top 2*b*. By means of an adjusting spindle 13, which is mounted, so as to be fixed against axial displacement, in the printing-press side frames 4*a* and 4*b* and which is formed with a thread corresponding to a thread formed in the side-lay body 11, it is possible for the side-lay body 11 to be adjusted in its position transversely to the sheet-conveying direction. A control shaft 14, which extends transversely with respect to the sheet-conveying direction and which is journalled in the printing-press side frames 4*a* and 4*b*, is driven in a conventional manner. A driving worm 16 is mounted on the control shaft 14 so as to be axially displaceable but fixed against relative rotation therewith, and is guided axially on the control shaft 14 in a conventional manner by the side-lay body 11. A gearwheel 17, which is mounted on a control shaft 18 journalled in the side-lay body 11, meshes with the driving worm 16. Likewise, a draw roller 19 is mounted on the control shaft 18. An axial cam 15 axially rotatably mounted on the control shaft 14 so as to be fixed against relative rotation therewith, and being likewise guided axially on the control shaft 14 by the side-lay body 11, is in continuous contact with a roller 21. The roller 21 is rotatably mounted on a lever 22. A dabber roller 20 is likewise rotatably mounted on the lever 22. The paper sheets fed to the side lay 5b are released, in a conventional manner, by the axial cam 15, via the lever 22, which acts upon the upper sides of the paper sheets, with the undersides thereof brought into contact with the draw roller 19, and brought by the draw roller 19 up against non-illustrated stops provided on the side-lay body 11.

As shown in FIGS. 1 and 2, the sheet-guiding surface between the table tops 2a and 2b on both sides of the suction belt 1 is formed, respectively, of a flexible metal belt 7 having a closed surface and revolving around a guide roller 8 in the respective printing-press side frame 4a and 4b and around two guide rollers 9 and 10 mounted in the table tops 2a and 2b. The revolving, uniformly flexible metal belt 7 is fastened to the side-lay body 11, preloaded in tension in the sheet travel plane, one of the ends of the belt 7 being fastened to a fastening location 35, and the other end to a fastening location 36. When the side lay 5b is adjusted, for example into a position 5b' shown in phantom in FIG. 2, it draws the revolving metal belt 7, with the fastening location 36 thereof likewise into the desired position. When the side lay 5b' has been returned to the initial position 5b thereof, the fastening location 35 then draws the metal belt 7 into the corresponding position.

As described hereinbefore, adjustment may be effected by means of the adjusting spindle 13. Likewise, it is conceivable to connect the guide roller 8 to suitable drive means, for example, to a handwheel for manual driving or, alternatively, to electric or pneumatic driving means and, by turning the guide roller 8, to adjust the side lay to the desired position via the supporting belt 7 and via the fastening locations 35 and 36, respectively.

It is likewise possible for the metal belt 7 to be used for the precise determination of the position of the side lay 5. For this purpose, it is conceivable, for example, to provide the metal belt 7 with displacement-measuring strips 37, preferably on the underside of the metal belt 7, the displacement-measuring strips 37 being scanned by conventional displacement-measuring sensors preferably 38 fastened to or in the printing-press side frames 4a and 4b. With the aid of an electronic evaluation system 39, a precise determination of the position of the side lay may then be made.

Another embodiment of the invention is shown in FIG. 3. A pliable, tensionally rigid metal belt 27 is fastened in the sheet-conveying or travel plane at a fastening location 34 to the printing-press side frame 4b. The metal belt 27 extends parallel to the sheet-conveying plane in a direction towards the center of the table; is deflected downwardly around a guide roller 32 attached to the side-lay body 11; is guided around a further guide roller 31 attached to the side-lay body 11 and around a guide plate 30 attached to the side-lay body 11, and returned to the sheet-conveying plane around a further guide roller 29 attached to the side-lay body 11. The metal belt 27 is fastened, under a preloading in tension, by an end thereof pointing away from the fastening location 34, to a fastening location 33 on a table projection 28 of one of the table tops 2a and 2b, respectively.

The side lay 5b is displaced from its position by the rotation of the spindle 13. With displacement of the side lay 5b, a displacement of the guide elements 32, 31, 30 and 29 also occurs. Between the fastening location 33 and the guide roller 29, on the one hand, and between the guide roller 32 and the fastening location 34, on the other hand, the metal belt 27 exhibits a flat or planar surface in the sheet-conveying plane at each position of the side lay 5b.

With this embodiment of FIG. 3, it is also conceivable to provide the metal belt 27 with displacement-measuring strips in order to determine the position of the side lay 5b, the displacement-measuring strips being likewise scanned by sensors attached to the side-lay body 11. With the aid of suitable evaluation electronics it is possible, once again, for the position of the side lay 5b to be accurately determined.

Also, in this embodiment, the metal belt 27 is preferably provided with a closed, i.e., continuous, surface.

As shown in FIG. 5a, the supporting belt 7 may be disposed, in the first embodiment of FIG. 1, both on a projection of the table top 2a and also on a projection of the table top 2b, in the sheet-conveying direction. The sheet-guiding surface of the table top 2a should be disposed slightly above the sheet-guiding surface of the metal belt 7, and the sheet-guiding surface of the metal belt 7 should be disposed slightly above the sheet-guiding surface of the table top 2b.

It is also conceivable for the metal belt 7 to be laid on only a projection of the table top 2b, as shown in FIG. 5b.

In the second specimen embodiment of FIG. 3, the metal belt 27, as shown in FIG. 6, does not have to rest on either of the two table tops 2a and 2b.

Instead of a metal belt 7, 27, it is conceivable to employ a smooth, tensionally rigid, yet pliable fabric belt.

The foregoing is a description corresponding in substance to German Application P 42 11 922.7, dated Apr. 9, 1992, the International priority of which is being claimed for the instant application, and which is hereby made part of this application. Any material discrepancies between the foregoing specification and the aforementioned corresponding German application are to be resolved in favor of the latter.

We claim:

1. Table cover for covering a recess formed in a feed table of a sheet-fed printing press, the recess being disposed in a sheet travel plane and extending over a width of a sheet format adjustable by a selective positioning of a side lay, comprising means defining a flexible surface of a table top extending over a distance corresponding to a maximum range of the width of a sheet format adjustable by the selective positioning of the side lay, said means defining said flexible surface being an integral member, and means for guiding said integral member from a location on one side of the side lay partly around the side lay to a location on an opposite side of the side lay.

2. Table cover according to claim 1, wherein said integral member is a flexible belt extending in a direction corresponding to the direction in which the side lay is positionally adjustable for setting the format width of a sheet.

3. Table cover according to claim 2, wherein said flexible belt is formed of pliable metal.

4. Table cover according to claim 2, wherein said flexible belt is formed of tensionally rigid, yet pliable fabric.

5. Table cover according to claim 2, wherein said flexible belt is fastened at one end thereof to a fixed location at a central region of the table top, and at the other end thereof to a side frame of the printing press, and said guiding means are disposed on the side lay and serve for guiding said flexible belt.

6. Table cover according to claim 2, wherein one end of said flexible belt is fastened at a side of the table cover extending away from the side lay towards the center of the table top, and the other end thereof is fastened at a side of the side lay extending away from the center of the table top, and said guiding means include guide rollers, at least one guide roller thereof being disposed on a frame of the printing press and at least another guide roller thereof being disposed at substantially the center of the table top, and serve for deflecting said flexible belt.

7. Table cover according to claim 6, wherein said flexible belt is part of an actuating means for adjusting the side lay.

8. Table cover according to claim 2, wherein said flexible belt comprises means for making a displacement measurement for at least one of setting the position and determining the position of the side lay.

9. Table cover according to claim 1, wherein said flexible surface and said side lay together form a closed surface.

* * * * *